United States Patent [19]

Wilson, Jr. et al.

[11] 4,218,677

[45] Aug. 19, 1980

[54] DETECTING LOOP DIGITAL INTERFACE CIRCUITRY

[75] Inventors: Stanley Wilson, Jr., St. Charles; Robert M. Borger, Overland, both of Mo.

[73] Assignee: Potter Electric Signal Co., St. Louis, Mo.

[21] Appl. No.: 16,918

[22] Filed: Mar. 2, 1979

[51] Int. Cl.[2] ..... G08B 21/00

[52] U.S. Cl. ..... 340/506; 340/510; 307/100

[58] Field of Search ..... 340/505, 506, 510, 531, 340/533, 599, 649, 652; 307/100, 240

[56] References Cited

U.S. PATENT DOCUMENTS

| | | | |
|---|---|---|---|
| 3,370,181 | 2/1968 | Sitomer | 307/100 |
| 4,065,762 | 12/1977 | Walter | 340/510 |
| 4,118,700 | 10/1978 | Lenihan | 307/100 |

*Primary Examiner*—Alvin H. Waring

*Attorney, Agent, or Firm*—Jerome A. Gross

[57] ABSTRACT

Digital interface circuitry is utilized to analyze the condition of alarm detecting loops. The new circuitry is utilized as an alarm system of the type which has a detecting loop extending between a central station and a remote zone at which is provided a normally open detection switch in parallel with a resistor. At the central station a digital high voltage is supplied to the input loop lead and a resistor is connected to ground from a reference point on the return lead, to provide a voltage divider network with the remote resistor. Two voltage-sampling branches connect to the reference point; the first branch has a comparator or pull-up circuit to indicate digitally whether the voltage level is substantially zero or greater, while the second branch has a level detector and pull-up circuit or a comparator to indicate digitally whether the reference point voltae is greater than its normal level. By the combination of these digital signals, a microprocessor or other digital circuit may interpret the condition of the detecting loop.

6 Claims, 2 Drawing Figures

DETECTING LOOP DIGITAL INTERFACE CIRCUITRY

BACKGROUND OF THE INVENTION

The present invention relates to alarm systems of the detecting loop type, for example, fire alarm circuits of the type classified by Underwriters Laboratories as Class B fire detection circuits.

Single detecting loop alarm circuitry conventionally utilizes a detecting loop from the central station to remote premises; the loop carries a dc current provided by a power supply at the central station. A resistor in parallel with a normally open detection switch, such as a heat sensitive switch, is provided in series with the loop at the remote premises. The loop lead which returns to the central station is coupled to an alarm circuit which utilizes two current-sensitive relays in series, a first relay which switches upon an increase in current, such as caused by closing of the detection switch and known as an "alarm" condition, and a second relay which switches upon a decrease in current, such as caused by a ground or open of the detecting loop and known as a "trouble" condition.

SUMMARY OF THE INVENTION

The primary purpose of the present invention is to provide circuitry, compatible with a conventional detecting loop extending between a central station and remote premises, to convert the alarm system from a current-sensitive system to a voltage-sensitive digital system.

Briefly summarizing, the present invention may be used with a conventional single detecting loop having the combination of a resistor in parallel with a normaly open detection switch at the remote premises in series in the loop. In the preferred embodiment of the invention, a "high" digital voltage is introduced on the loop input lead at the central station by a voltage supply, including a current limiter. From a point on the loop return lead at the central station, referred to as the reference point, a ground resistor is connected to ground potential, providing a voltage divider with the resistor at the remote premises. When the switch is closed, the voltage at the reference point will be substantially the "high" digital voltage, but when the switch is open, it will be at an intermediate normal level.

From the reference point, a first voltage-sampling branch includes an active transistor pull-up circuit to indicate digitally whether the reference point voltage is either a voltage sufficient to actuate the pull-up circuit transistor or substantially zero, the latter indicating a "trouble" condition, as from grounding or breaking a loop lead. A second voltage-sampling branch from the reference point has a voltage level detector and active pull-up circuit; these respond to voltage in excess of the intermediate normal level indicating an "alarm" condition with a "high" digital indication. The pair of branches thus indicate, by three different output combinations, whether the loop condition is normal, "trouble", or "alarm".

Where numerous detecting loops are to be monitored, a single microprocessor may be used, both to read the digital outputs and to serve as the input lead voltage supply by pulsing the input with the "high" digital voltage during the period that the outputs are being read.

DESCRIPTION OF THE PREFERRED EMBODIMENT

Figure 1:
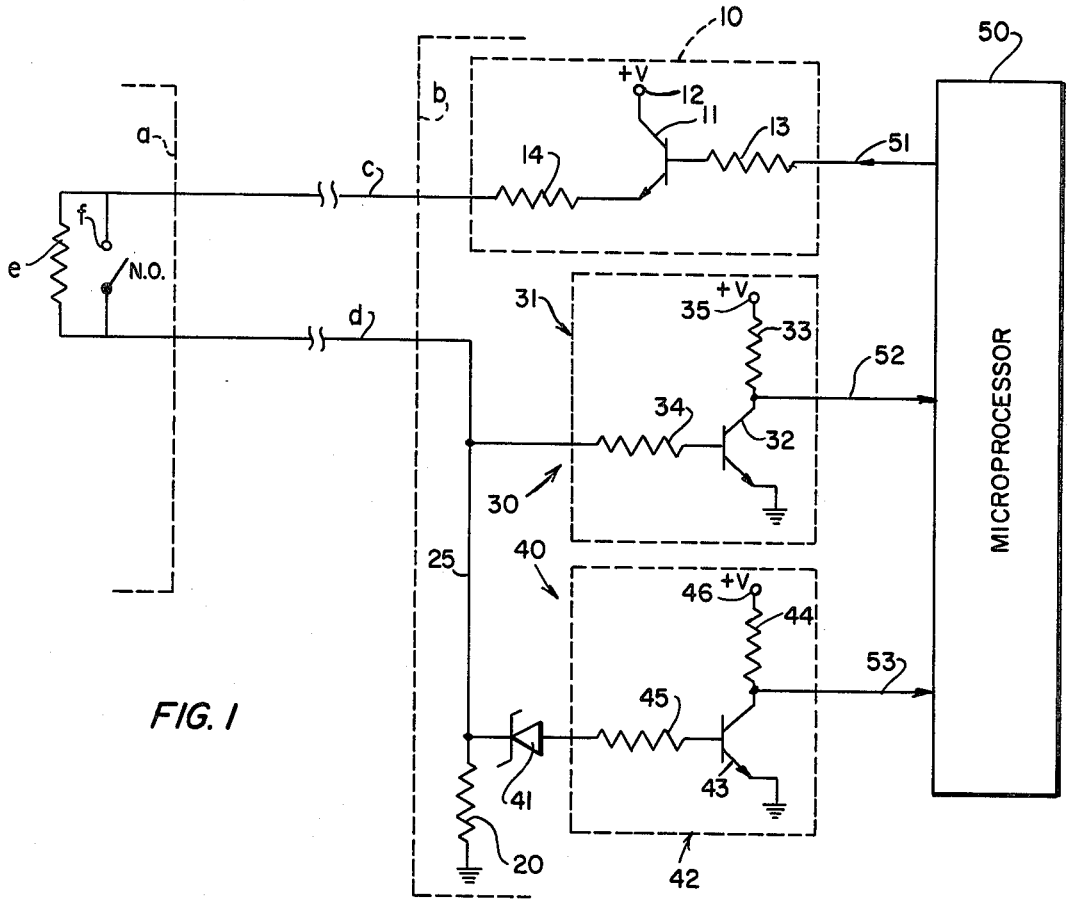
FIG. 1 is a circuit diagram of a preferred embodiment of the detecting loop digital interface circuitry.

The preferred embodiment of the present invention, shown in FIG. 1, utilizes a conventional detecting loop which extends from remote premises bounded by the dashed line marked a, in FIG. 1, to a central station, bounded by the dashed line marked b. The detecting loop includes an input lead c extending from the central station b to the remote premises a and a return lead d extending from the remote premises a to the central station b. At the remote premises a, the input lead c and return lead d are joined by a series loop resistor e, made up of a 1.1 K-ohm resistor. In parallel with the loop resistor e is a normally open detection switch f, which closes upon the occurrence of an alarm condition, such as detection of heat caused by a fire.

In the preferred embodiment, the input lead c at the central station b is coupled to a power supply 10. The power supply 10 includes a power transistor 11 connected by its collector to a 5 volt dc source 12, by its base to a base resistor 13 and by its emitter to a current limiting resistor 14, which is here a 100 ohm resistor coupled to the input lead c at the central station b.

Also at the central station b, the return lead d is coupled to a ground resistor 20, which is here made up of a 1.1 K-ohm resistor coupled to ground potential. The coupling between the return lead d and ground resistor 20 is hereinafter referred to as the reference point 25, and may consist of a terminal or a lead.

Connected to the reference point 25 is a first voltage sampling branch, generally designated 30, which includes a pull-up circuit, generally designated 31. The pull-up circuit 31 has a pull-up transistor 32 whose emitter is coupled to ground potential, its collector to a pull-up resistor 33 and its base to a base resistor 34. The base resistor 34 is coupled to the reference point 25 and the pull-up resistor 33 is coupled to a 5 volt dc source 35. The output of the pull-up circuit 31 is at the connection of the collector of the pull-up transistor 32 with the pull-up resistor 33.

Connected to the reference point 25 is a second voltage-sampling branch, generally designated 40, which has a zener diode 41 whose cathode is coupled to the reference point 25 and whose anode is coupled to a pull-up circuit 42, which is similar to the pull-up circuit 31 of the first sampling branch 30. The zener diode 41 here utilized is one which has a breakdown voltage of 3.1 volts, thus it conducts when the voltage from cathode to anode exceeds 3.1 volts. The pull-up circuit 42 likewise includes a pull-up transistor 43 which has its emitter coupled to ground potential, its collector to a pull-up resistor 44 and its base to a base resistor 45. The base resistor 45 is coupled to the anode of the zener diode 41, the pull-up resistor 42 is coupled to a 5 volt dc source 45, and the output of the pull-up circuit 42 is at the common terminal of the pull-up resistor 44 and the collector of the pull-up transistor 43.

In order to determine the condition of the detecting loop, a conventional microprocessor, generally designated 50, is utilized, as shown in FIG. 1. The microprocessor 50 is shown coupled to a single detecting loop, cut could be used to monitor a great number of such loops. The microprocessor 50 has an output 51 capable of producing a pulse; this output 51 is coupled to the base resistor 13 of the power supply 10, whereby to cause the power supply 10 to turn on when it is desired to check the condition or status of the detecting loop.

Two inputs 52, 53 of the microprocessor are connected to the outputs of the voltage-sampling branches 30, 40, that is, the outputs of the pull-up circuits 31, 42.

In manufacture of the present digital interface circuitry, it may be advantageous to construct printed circuit boards including one or more of the combination of the power supply 10 with the ground resistor 20, and voltage-sampling branches 30, 40. The microprocessor 50 can monitor a large number of such printed circuit board circuits by time-sharing.

In operation of the interface circuitry, the microprocessor 50 pulses the power supply 10, causing it to momentarily produce approximately 5 volts dc through the current limiting resistor 14 to the detecting loop input lead c. Assuming the detecting switch f is open and the detecting loop is otherwise in a normal condition, current flows through the loop resistor e and the ground resistor 20 to ground, causing a voltage division so that the voltage at the reference point 25 is approximately 2.4 volts. The 2.4 volts on the reference point 25 causes the pull-up transistor 32 of the first voltage-sampling branch 30 to conduct, which causes the output of the pull-up circuit 31 to be pulled down to approximately zero volts, the digital low signal state. In the second voltage-sampling branch 40, the zener diode 41 does not conduct, so the pull-up transistor 43 is off and the output of the pull-up circuit 42 is on the order of 5 volts, or the digital high signal state.

If the normally open detection switch f should be closed, indicating an alarm condition, the loop resistor e is shunted and the reference point voltage becomes approximately 4.6 volts. The pull-up transistor 32 in the first sampling branch 30 is on, causing the output of the pull-up circuit 31 to be low. The zener diode 41 is conducting, its 3.1 volt breakdown voltage being exceeded; thus, the pull-up transistor 43 conducts and the output of the pull-up circuit 42 is pulled low.

When the normally open detection switch f is open and the detecting loop is subject to an interruption or trouble condition, such as an open or a ground fault of either the input lead c or return lead d, the voltage of the reference point 25 is substantially zero. This causes the pull-up transistor 32 to be off and the output of the first voltage-sampling branch 30 to be high. Likewise, the zener diode 41 and pull-up transistor 43 in the second voltage-sampling branch 40 are non-conducting, causing the output of the pull-up circuit 42 to be high.

Summing up, three different combinations of digital signals are provided by the present interface circuitry as inputs to the microprocessor on pulsing by the microprocessor via the power supply 10. For the normal condition, the output of the first sampling branch 30 is low, while the output of the second sampling branch 40 is high. For an alarm condition, during which the normally open switch f is closed, both outputs are low. For a trouble condition, in which the detecting loop is either opened or shorted to ground, both outputs are high.

Figure 2:
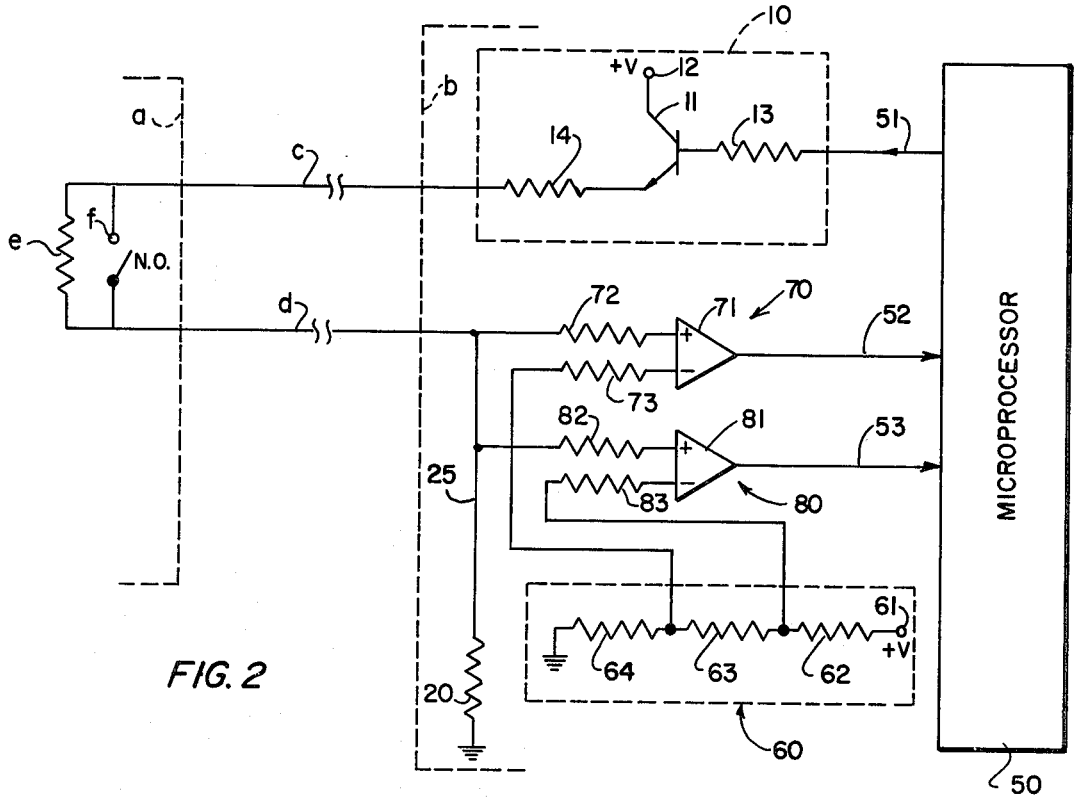
FIG. 2 is a circuit diagram of an alternative embodiment of the detecting loop digital interface circuitry.

An alternative embodiment of the present invention is shown in FIG. 2. It utilizes an identical detecting loop extending from the remote premises a to the central station b, including input and return leads c, d, the loop resistor e and the normally open detection switch f. At the central station, it utilizes a microprocessor 50 having an output 51 connected to the power supply 10, which is coupled to the input lead c. The ground resistor 20 is connected from the reference point 25 to ground potential.

The alternative embodiment differs first in that it has a voltage divider network, generally designated 60, made up of a 5 volt dc supply 61 coupled through first, second and third series resistors, 62, 63, 64 to ground potential. The resistors 62, 63, 64 are so chosen that the common terminals of the first and second resistors 62, 63 is at 3.1 volts and the common terminals of the second and third resistors 63, 64 is at 1.0 volt.

Two voltage-sampling branches are utilized in the alternative embodiment; they differ in construction from the embodiment heretofore described; the first voltage-sampling branch, generally designated 70, and coupled to the reference point 25, has an operational amplifier 71, used as a comparator, whose non-inverting input is coupled by an input resistor 72 to the reference point 25 and whose inverting input is connected by an input resistor 73 to the common terminals of the second and third resistor 63, 64, to thereby receive 1.0 volt. The second voltage-sampling branch, generally designated 80, has an operational amplifier 81, likewise used as a comparator, having its non-inverting input coupled by an input resistor 82 to the reference point 25 and its inverting input coupled by an input resistor 83 to the common terminals of the first and second resistors 62, 63 of the voltage divider network 60, thus receiving 3.1 volts.

Construction of the alternative embodiment may be substantially as in the preferred embodiment, such as on a printed circuit board. Operation is substantially the same, except that the outputs are in each case inverted from the output of the preferred embodiment. For normal operation, with the voltage at the reference point 25 approximately 2.4 volts, the first branch operational amplifier 71 is on, producing a high, while the second branch operational amplifier 81 is off, producing a low. For an alarm condition, with the switch f closed and the voltage at the reference point 25 approximately 4.6 volts, both operational amplifiers 71, 81 are on, producing digital high voltages. For a trouble condition, in which the detecting loop is either open or shorted to ground, the voltage at the reference point 25 is approximately zero volts and both operational amplifiers 71, 81 are off, each producing a digital low. The microprocessor is programed to read and interpret the resulting outputs of the sampling branches 70, 81 as it pulses the input lead c.

Modifications of the two above-described embodiments will be apparent to persons skilled in the art. For example, a similar result may be achieved by a circuit similar to the preferred embodiment, but with the pull-up circuitry ommited from the sampling branches and with the second sampling branch only having a voltage level detector, which yields a digital signal indicating whether the voltage level at the reference point 25 is either substantially the normal intermediate voltage level or has departed from that voltage in a selected sense. A digital processor used with such circuitry must have a threshhold level of transition, from one digital state to the other digital signal state, which is either less than or exceeds said normal intermediate voltage level, this depending upon the selected sense of departure from the normal indicated by the chosen voltage level detector. Other types of voltage level detection means can be utilized in the sampling branches, such as other types of voltage comparators. Various other modifications will, from these examples, suggest themselves.

We claim:

1. For use in an alarm system of the type utilizing a detecting loop having an input lead extending from a central station to a remote protection zone, a return lead extending from the remote protection zone to the central station, such input and return leads being subject to grounding and open loop interruptions, such detecting loop further having a loop resistance in parallel connection with a normally open detection switch which closes upon the occurrence of an alarm condition, both coupled between such input and return leads in the remote protection zone, detecting loop digital interface circuitry comprising means, coupled to such input lead at the central station, to introduce an input voltage on such input lead and to limit the current therein, a ground resistor coupled from a reference point on the return lead at the central station to substantially ground potential, whereby to provide voltage division with such loop resistance which effects a normal intermediate voltage level at said reference point, a first voltage-sampling branch coupled to said reference point at such central station including active pull-up circuit means to produce a high digital signal at its output when the voltage at said reference point substantially exceeds zero volts, and a second voltage-sampling branch coupled to said reference point at such central station including voltage level detector and active pull-up circuit means to produce a high digital signal at its output when the voltage at said reference point exceeds said normal intermediate voltage level, whereby said voltage-sampling branches produce combinations of digital signals indicating normal, alarm, and loop interruption conditions.

2. The detecting loop digital interface circuitry as defined in claim 1, in combination with a digital processor having an output coupled to said means to introduce an input voltage, and having inputs coupled to the outputs of said voltage-sampling branches, said processor having means so to act on said means to introduce an input voltage as to apply a high digital voltage input pulse to such loop input lead and simultaneously to read and interpret the resulting outputs of said sampling branches, whereby to permit time-sharing of said processor with the output data from the detecting loop sampling branch outputs of a plurality of other similar interface circuitry.

3. For use in an alarm system of the type utilizing a detecting loop having an input lead extending from a central station to a remote protection zone, a return lead extending from the remote protection zone to the central station, such input and return leads being subject to grounding and open loop interruptions, and a loop resistance in parallel connection with a normally open detection switch which closes upon the occurrence of an alarm condition, both coupled between such input and return leads in the remote protection zone, detecting loop digital interface circuitry comprising voltage supply means, coupled to such input lead at the central station, to introduce an input voltage on such input lead, a ground resistor coupled from a reference point on the return lead at the central station to substantially ground potential, whereby to provide voltage division with such loop resistance and thereby to effect a normal intermediate voltage level at said reference point indicating a normal condition, a first voltage-sampling branch coupled to said reference point at such central station, whereby substantially such input voltage is produced at the output of said first branch when such detection switch is closed and zero volts is produced when either the input or return lead is interrupted, and a second voltage-sampling branch coupled to said reference point at such central station including voltage level detection means to yield a first digital signal indicating that the voltage at said reference point is substantially said normal intermediate voltage level and to produce a second digital signal indicating that such voltage has departed in a selected sense from said normal level.

4. The detecting loop digital interface circuitry as defined in claim 3, wherein said selected sense of departure from normal intermediate voltage level, indicated by such second digital signal, is an increase over said normal level, a digital processor having inputs coupled to the outputs of said voltage-sampling branches, said processor having a threshhold voltage level of transition from one digital signal state to the other digital signal state which is less than said normal intermediate voltage level, whereby by distinguishing voltage levels, said processor may determine whether the loop is in normal, alarm or loop interruption condition.

5. The detecting loop digital interface circuitry as defined in claim 3, wherein said selected sense of departure from such normal level indicated by such second digital signal is a decrease from said normal intermediate voltage level, in combination with a digital processor having inputs coupled to the outputs of said voltage-sampling branches, said processor having a threshhold voltage level of transition from one digital signal state to the other digital signal state which is greater than said normal intermediate voltage level, whereby by distinguishing voltage levels, said processor may determine whether the loop is in normal, alarm or loop interruption condition.

6. For use in an alarm system of the type utilizing a detecting loop having an input lead extending from a central station to a remote protection zone, a return lead extending from the remote protection zone to the central station, and loop resistance means, connected therebetween at such remote protection zone, such detecting loop being of the type whose total resistance is changed on the occurrence of a condition to be detected, detecting loop digital interface circuitry comprising means, coupled to such input lead at the central station, to introduce an input voltage on such input lead, a ground resistor coupled from a reference point on the return lead at the central station to substantially ground potential, whereby to provide voltage division with such loop resistance means which effects a voltage at said reference point, a plurality of voltage-sampling branches coupled to said reference point at such central station, each of said branches having voltage comparator means to respond to such voltage of said reference point, each responding to a different voltage level thereof, whereby to provide a plurality of digital outputs whose analysis in combination indicates the condition of such detecting loop.

* * * * *